US005248188A

United States Patent [19]

Walgren

[11] Patent Number: 5,248,188

[45] Date of Patent: Sep. 28, 1993

[54] CHAIN FOR TRENCHER APPARATUS

[76] Inventor: Craig B. Walgren, P.O. Box 1211, Lake Havasu City, Ariz. 86403

[21] Appl. No.: 898,449

[22] Filed: Jun. 15, 1992

[51] Int. Cl.[5] ..... E02F 3/08; E21C 25/40

[52] U.S. Cl. ..... 299/83; 37/465; 200/91

[58] Field of Search ..... 299/82, 83, 84, 91, 299/63; 37/191 A, 192 A; 172/100, 542; 175/89

[56] References Cited

U.S. PATENT DOCUMENTS 2,780,014 2/1957 Arps ..... 37/191 A
3,913,979 10/1975 Strauss et al. ..... 299/84
4,626,032 12/1986 Harris et al. ..... 299/84 X
4,775,189 10/1988 Den Besten ..... 299/83 X

*Primary Examiner*—David J. Bagnell
*Attorney, Agent, or Firm*—Tod R. Nissle

[57] ABSTRACT

Apparatus for forming a trench in the ground includes a frame having ground engaging wheels, a boom attached to and extending outwardly from the frame, a chain which extends around the periphery of the boom, a plurality of cutting teeth mounted on the chain, and a motor mounted in the frame for driving the chain around the boom. The cutting teeth are mounted on the chain in a canted orientation which extends the useful life of the teeth.

8 Claims, 2 Drawing Sheets

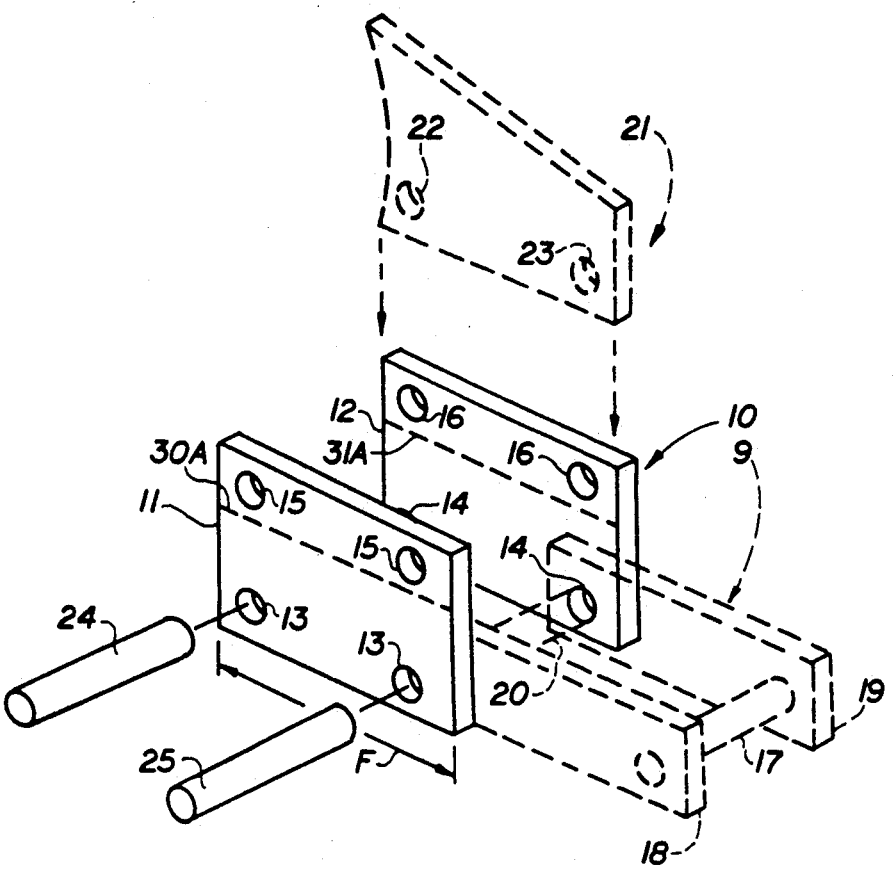
FIG. 1: PRIOR ART
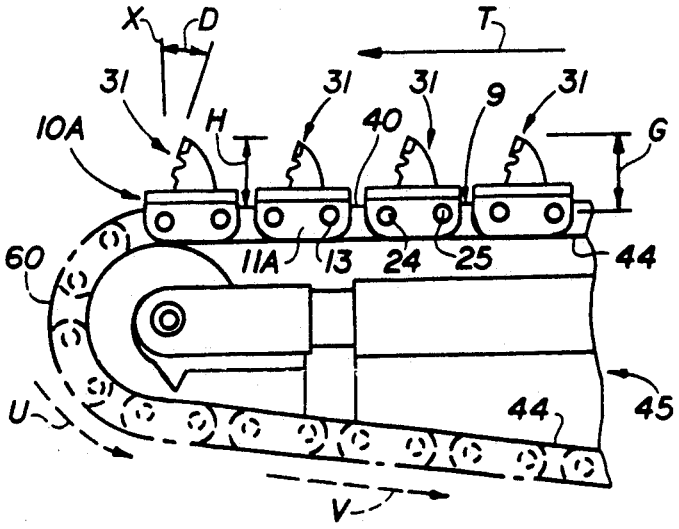
FIG. 4

CHAIN FOR TRENCHER APPARATUS

This invention relates to apparatus for forming a trench.

More particularly, the invention relates to trenching apparatus of the type including a frame having ground engaging wheels, a boom attached to and extending outwardly from the frame, a chain which extends around the periphery of the boom, a plurality of cutting teeth mounted on the chain, and a motor mounted in the frame for driving the chain around the boom such that the chain can dig a trench in the ground.

In a further respect, the invention relates to trenching apparatus of the type described which significantly extends the life of the chain and enables the operational life of the teeth mounted on the chain to equal or exceed the life of the chain.

Trenching apparatus is well known in the art. See, for example, U.S. Pat. No. 2,675,219 to Proctor, U.S. Pat. No. 2,780,04 to Arps, U.S. Pat. No. 2,807,452 to Joy, U.S. Pat. No. 3,223,452 to Krekeler, U.S. Pat. No. 3,484,844 to Peterson, U.S. Pat. No. 3,614,164 to Davis, U.S. Pat. No. 3,913,979 to Strauss et al., U.S. Pat. No. 3,968,995 to Arentzen, U.S. Pat. No. 4,089,561 to Carden, U.S. Pat. No. 4,143,920 to Haddock, U.S. Pat. No. 4,404,761 to Paulin et al. and U.S. Pat. No. 4,775,189 to Den Besten. Such conventional trenching machines usually include a frame having ground engaging wheels, a boom attached to and extending outwardly from the frame, a chain which extends around the periphery of the boom (in much the same manner that a chain extends around the boom of a chain saw), a plurality of cutting teeth mounted on the chain, and a motor mounted in the frame for driving the chain around the boom such that the chain can dig a trench in the ground. One of the principal disadvantages associated with prior art trenching machines is that the cutting teeth which are mounted on the chain wear more rapidly than the chain. This is why most present day trenching machines use teeth which can be removed from the chain and replaced by new teeth. Removing and replacing the teeth on the chain of a trenching machine is time consuming and expensive.

Accordingly, it would be highly desirable to provide improved trenching apparatus of the type described in which the life of the teeth was equal to or exceeded the life of the chain carrying the teeth.

Therefore it is a principal object of the invention to provide improved trenching equipment.

A further object of the invention is to provide improved trenching equipment of the type including a frame mounted on ground engaging wheels, a boom attached to and extending outwardly from the frame, a chain which extends around the periphery of the boom, a plurality of cutting teeth mounted on the chain, and a motor mounted in the frame for driving the chain around the boom such that the chain can dig a trench in the ground.

Another object of the invention is to provide improved trenching equipment of the type described in which the cutting teeth are shaped and dimensioned and mounted on the chain such that the operational life of the cutting teeth is equivalent to the operational life of the chain.

These and other, further and more specific objects and advantages of the invention will be apparent to those skilled in the art from the following detailed description thereof, taken in conjunction with the drawings, in which:

FIG. 1 is a perspective view illustrating the construction of the chain and cutting teeth utilized in prior art trenching apparatus;

FIG. 4 is a side view illustrating the chain of FIG. 2 on the boom of trencher apparatus.

Figure 2:
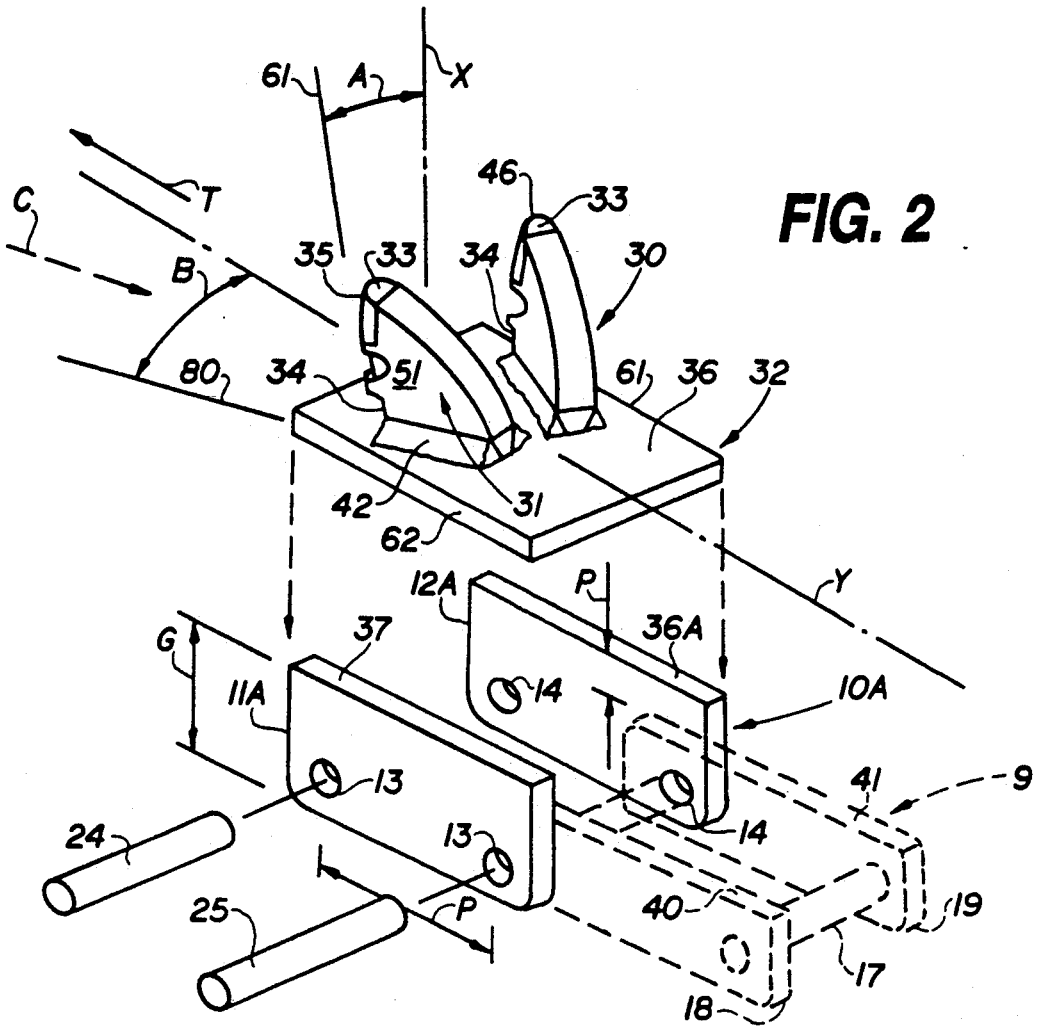
FIG. 2 is a perspective view illustrating the construction of the chain and cutting teeth utilized in trenching apparatus constructed in accordance with the invention.

Briefly, in accordance with my invention, I provide apparatus for forming a trench. The apparatus includes a frame including a plurality of ground engaging wheels; a boom attached to and having a distal end extending outwardly from the frame, the distal end having a peripheral edge; and, a chain extending around the peripheral edge of the boom. The chain includes a plurality of connector links and roller links. Each connector link is pivotally attached to and interconnects a pair of roller links. At least one of the connector links includes a pair of spaced apart opposed side walls each having an upper edge spaced outwardly apart from the peripheral edge of the boom, a plate permanently attached to the side walls adjacent the upper edges, and a tooth permanently attached to the plate and extending outwardly from the upper edges and away from the boom. A motor is mounted on the frame to drive the chain.

Turning now to the drawings, which depict the presently preferred embodiments of the invention for the purpose of illustrating the practice thereof, and not by way of limitation of the scope of the invention, and in which like reference characters refer to corresponding elements throughout the several views, FIG. 1 illustrates a chain and cutting tooth construction which is found on conventional trenching machines and includes alternating connector links 10 and roller links 9. Each connector link 10 includes a pair of parallel opposed spaced apart plates 11, 12. Plate 11 includes apertures 13, 15 formed therethrough. Plate 12 includes apertures 14, 16 formed therethrough. At least one tooth 21 is removably attached to each connector link 10 with bolts (not shown) which each pass through an aligned aperture pair 23--16 or 22--16 to secure the tooth 21 to plate 12 of link 10. If desired, an additional tooth can be secured to plate 11 by bolts which would each pass through an aperture pair 22--15 or 23--15 to secure the tooth 21 to plate 11.

Each roller link 9 includes a pair of parallel opposed spaced apart side walls or surfaces 18, 19. Walls 18, 19 are interconnected by hollow cylindrical members 17, 20 each fixedly connected at either end to an aperture formed through one of walls 18, 19. Each end of a roller link 9 is, in well known fashion, pivotally connected to a connector link 10 at a position intermediate the plates 11, 12 of the connector link by inserting a pin 25 through, for example, an aperture 13, through a hollow member 20, and through an aperture 14 in the manner indicated in FIG. 1. In FIG. 1, the other end of roller link 9 ordinarily would be connected to another connector link (not depicted) by passing a pin 24 through an aperture 13 in the connector link 10, through hollow member 17, and through an aperture 14 in the connector link 10. Such alternating pivotal connection of roller links 9 and connector links 10 to form a continuous chain loop comprised of alternating links 9 and links 10 is well known in the art.

When a tooth 21 wears out, it is removed from plate 12 (or 11) by loosening the bolts and nuts which secure the tooth 21 to plate 12. A new tooth 21 is secured to plate 12 using nuts and bolts. Such removal of old teeth 21 and replacement with new teeth 21 is time consuming and relatively expensive.

Chain constructed in accordance with the invention is illustrated in FIGS. 2 to 4. In FIG. 2, plate 11A is equivalent to what remains of plate 11 in FIG. 1 when plate 11 is cut along dashed line 30A and the cut upper portion of plate 11 is discarded. The upper portion of plate 11 which is discarded includes apertures 15. Similarly, plate 12A is equivalent to what remains of plate 12 in FIG. 1 when plate 12 is cut along dashed line 31A and the cut upper portion of plate 12 is discarded. The upper portion of plate 12 which is discarded includes apertures 16.

In FIG. 2, plate 32 is welded or otherwise permanently attached to or adjacent the upper edges 36A and 37 of plates 11A and 12A. Cutting teeth 30 and 31 are each permanently welded 42 or otherwise affixed to plate 32. Plate 32 can, if desired, be removably attached to plates 11A, 12A and teeth 30 and 31 can, if desired, be removably affixed to the upper planar surface 36 of plate 32. It is, however, presently preferred that teeth 30 and 31 and plate 32 be permanently attached to surface 36 and adjacent edges 36A, 37, respectively, in the manner described.

One or more teeth 30, 31 can be affixed to a plate 32 of a connector link 10.

In FIG. 1, the length of a plate 11 is indicated by arrows F and is, for example, about two and seven-eighths of an inch for a 1.654 inch pitch chain. The pitch of a chain is determined by measuring the distance, indicated by arrows P in FIG. 2, between the centers of the pins 24, 25 each extending intermediate aperture pairs 13--14. Consequently, in a 1.654 inch pitch chain, the distance P in FIG. 2 equals 1.654 inches. In a 2.00 inch pitch chain the distance P equal 2.00 inches; in a 2.609 inch pitch chain the distance P equals 2.609 inches; in a 3.00 inch pitch chain, the distance P equals 3.00 inches; and, in a 3.250 inch pitch chain, the distance P equals 3.250 inches.

Figure 3A:
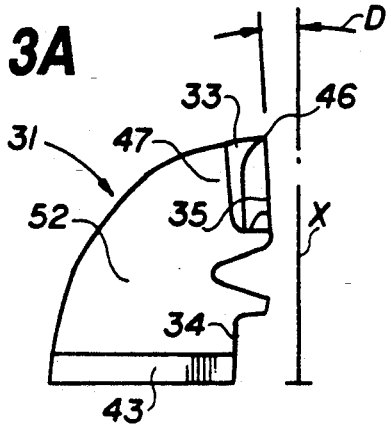
FIG. 3A is a side view of a cutting tooth utilized in the apparatus of FIG. 2.
Figure 3B:
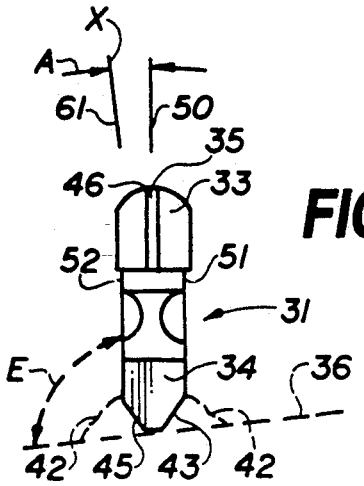
FIG. 3B is a front view of the cutting tooth of FIG. 3A.

In FIG. 2, the height, indicated by arrows G, of plate 11 in a 1.654 inch pitch chain is about 1.50 inches. The upper edges 40 and 41 of the walls 18, 19 of roller link 9 are indicated in FIG. 2. The longitudinal axis or centerline Y of plate 32 bisects the plate and passes intermediate teeth 30 and 31. A first flat reference plane passes through the X and Y axes. The X axis is perpendicular to the planar flat surface 36 of plate 32. As shown in FIG. 3B, a second reference plane 50 bisects tooth 31 and is equidistant from and parallel to the sides 51 and 52 of tooth 31. Tooth 30 is equal in shape and dimension to tooth 31. Plane 50 also bisects the base of tooth 31. The base of tooth 31 includes parallel canted side surfaces 43 and 45 and front surface 34. A bit 33 made from carbide or another desirable cutting material is mounted in the body 52 of tooth 31. The bit 33 includes a distal tip 46 and a cutting edge 35.

In FIG. 2, the tooth 31 is attached in fixed position to plate 32 such that the line of intersection between surface 36 and the second reference plane 50 (and between surface 36 and the bottom of tooth 31) (FIG. 3B) is at an angle to the first reference plane (which passes through axes X and Y) indicated by arrows B. Arrows B lie in a flat plane which passes through flat planar surface 36 of plate 32. The base of tooth 31 can be moved to the general position shown in FIG. 2 by pivoting tooth 31 from a first reference position about a first pivot axis which is parallel to axis X and intersects the second reference plane 50. In the first reference position, tooth 31 is upright and perpendicular to surface 36 and plane 50 of tooth 51 (and tooth 51) is parallel to axis Y and to axis X. Consequently, tooth 31 is moved from the first reference position to a position in which the line of intersection between surface 36 and the second reference plane 50 is at an angle B to axis Y by pivoting tooth 31 about the first pivot axis through an angle B such that the bottom of tooth 31 contacts plane 36 along a line of intersection parallel to line 80.

In FIG. 2, the tooth 31 is also attached in fixed position to plate 32 such that the second reference plane 50 is canted with respect to the first reference plane and surface 36. The angle E shown in FIG. 3B is greater than 90 degrees and indicates the cant of plane 50 (and sides 51 and 52) with respect to surface 36. In other words, the tooth 31 is pivoted about a second pivot axis which lies in flat planar surface 36 and in the second reference plane 50. In FIG. 3B, plane 50 is perpendicular to the plane of the sheet of paper of the drawings. In FIG. 2, the angle between axes 61 and X is indicated by arrows A. Axes 61 and X lie in a plane which is perpendicular to faces 51, 52 of tooth 30. Axis 61 lies in plane 50. Angle A also indicates the cant of plane 50 with respect to the first reference plane.

The dual pivoting, or canting, of tooth 31 about the first and second pivot axes is crucial in the manufacture and use of the invention. Such canting largely prevent the "scouring" or wearing of the areas 47 of body 52 which are immediately behind the carbide bit 33. Since the body 52 is normally softer than bit 33, the areas 47 adjacent and behind bit 33 tend to wear rapidly in comparison to bit 33. Angle B is in the range of fifteen degrees to forty-five degrees, preferably twenty-five degrees to thirty-five degrees. Angle A is in the range of five degrees to forty degrees, preferably ten to twenty degrees. Angle B indicates the arc through which tooth 31 is rotated about the first pivot axis from the first reference position of tooth 31. When tooth 31 is in the first reference position, plane 50 is, as noted, parallel to the first reference plane. Angle A indicates the arc through which tooth 31 is rotated about the second pivot axis from a position in which plane 50 is parallel to the first reference plane and in which the base of tooth 31 is at an angle B with respect to axis Y. Angle E lies in a plane perpendicular to plane 50 when tooth 31 is in the position illustrated in FIGS. 2 and 3B. Angle E is in the range of ninety-five degrees to one hundred and thirty degrees, preferably one hundred to one hundred and ten degrees. Tooth 30 is positioned on plate 32 in a manner similar to that tooth 31. In FIG. 2, tooth 30 is the mirror image of tooth 31. The angle between the axis Y and the line of intersection between the base of tooth 30 and surface 36 is equal to angle B; the second reference plane 50 bisecting tooth 30 is also, like the reference plane 50 bisecting tooth 31, at an angle A with respect to angle X; etc.

Also important in the practice of the invention is the mounting of tooth 33 on surface 36 such that the cutting edge 35 is rearwardly canted with respect to axis X. Edge 35 is rearwardly canted when it is canted away from axis X in a direction opposite that of the general direction of travel of the chain on boom 45. The general direction of travel of the chain on the boom 45 of a trenching machine is indicated by arrows T in FIGS. 2 and 4. The magnitude of the rearward cant angle of edge 35 is indicated in FIG. 3A by arrows D and is preferably in the range of five to eight degrees.

Another important feature of the invention is the low height or profile of each tooth 30, 31 with respect to the roller links 9. One of the best indicators of the low profile of the teeth 30, 31 of the invention is the shortest distance, indicated by arrow P in FIG. 2, from the plate 32 to the upper edges 40, 41 of an adjacent roller link 9 which is connected to the connector link 10A carrying plate 32 and which is directly beneath plate 32. In the practice of the invention, distance P is preferably in the range of one-eighth of an inch to one-half of an inch, regardless of the pitch chain utilized. For a 1.654 inch pitch chain, distance P is preferably about one-eighth of an inch. Another indicator of the low profile of the teeth of the invention is the shortest vertical distance, indicated by arrows G in FIG. 4, from the centerpoint of a pin 24, 25 to the distal tip of a tooth 30, 31. For a 1.654 pitch chain, the distance G is presently about three and one-quarter inches. Still another indicator of the low profile of the teeth of the invention is the shortest vertical distance, indicated by arrows H in FIG. 4, from the upper edge 40 or 41 of a roller link 9 to the distal tip of a tooth 31, where the height of the tooth 31 from the distal tip to the bottom of the tooth 31 is about two inches. For a 1.654 pitch chain, the distance H is presently about two and one-half inches, where the height from the distal tip to the bottom of the tooth 31 is about two inches.

FIG. 4 illustrates a chain constructed in accordance with the principles of the invention and mounted on a chain which travels about the periphery 44 of the boom 45 of a trenching machine. The boom is mounted in conventional fashion to a frame (not shown) having ground engaging wheels. A motor (not shown) is mounted on the frame and drives the continuous, endless chain in the direction of arrow T about the periphery 44 of the boom 45, in much the same fashion that the chain on a chain saw is driven about the periphery of the chain saw boom in order to cut wood. Frames, motors, booms, and means for mounting the booms on frames are well known in the trenching apparatus art and will not be discussed here. The travel of endless chain 60 about the peripheral edge 44 of boom 45 is further indicated by dashed arrows U and V in FIG. 4.

In the practice of the invention, the left hand most connector link 10A in FIG. 4 normally carries a single tooth 31 which is centered on plate 32 and is upright, i.e., the second plane 50 passing through the tooth 31 is perpendicular to surface 36 of plate 32. The link 10A in FIG. 4 immediately adjacent the left hand most link 10A also carries a single upright tooth 31 which is, instead of being positioned in the center of plate 32, positioned to the right hand side of plate 32 near edge 61 (FIG. 2). The second link 10A to the right of the left hand most link in FIG. 4 also carries a single upright tooth which is, instead of being positioned in the center of plate 32, positioned to the left hand side of plate 32 near edge 62 (FIG. 2). Finally, the third link 10A to the right of the left hand most link in FIG. 4 carries a pair of teeth 30, 31 in an orientation comparable to that illustrated in FIG. 2. When the chain illustrated in FIG. 4 is operated, the low profile of teeth 30 and 31, the rearward canting of bit 33 with respect to axis X (FIG. 3A), and the canting of the body of each tooth 30 and 31 away from the first reference plane result in a chain which has very little wear of the tooth body such that the life of the teeth mounted on the chain equals or exceeds the life of the chain. The long life of the teeth greatly simplifies construction of the chain of the invention because the teeth and the plate 32 can be permanently mounted on the chain.

I claim:

1. Apparatus for forming a trench, said apparatus including (a) a frame including a plurality of ground engaging wheels;

(b) a boom attached to and having a distal end extending outwardly from said frame, said distal end having a peripheral edge;

(c) a chain extending around said peripheral edge of said boom, said chain having a pitch selected from the group consisting of a 1.654 inch pitch, a 2.00 inch pitch, a 2.609 inch pitch, a 3.00 pitch, and a 3.250 inch pitch and including a plurality of connector links and roller links, each connector link pivotally attached to and interconnecting a pair of said roller links, at least one of said connector links including (i) a pair of spaced apart opposed side walls each having an upper edge spaced outwardly apart from said peripheral edge, (ii) a plate (32) permanently attached to said side walls adjacent said upper edges, and (iii) a tooth (30) permanently attached to said plate and extending outwardly from said upper edges and away from said boom, said tooth (30) including a body and a bit (33) attached to said body, said body having a lower portion permanently attached to said plate (32) and having an upper portion, said bit (33) being attached to said upper portion of said tooth (30); and, (d) a motor mounted on said frame to drive said chain.

2. The apparatus of claim 1, wherein said bit is permanently attached to said upper portion.

3. Apparatus for forming a trench, said apparatus including (a) a frame including a plurality of ground engaging wheels;

(b) a boom attached to and having a distal end extending outwardly from said frame, said distal end having a peripheral edge;

(c) a chain extending around said peripheral edge of said boom for movement around said peripheral edge in a selected direction of travel, said chain including a plurality of connector links and roller links, each connector link pivotally attached to and interconnecting a pair of roller links, each of said roller links including a pair of outer walls each having an upper edge, said upper edges lying in a common plane, at least one of said connector links including (i) a pair of spaced apart opposed side walls each having an upper edge spaced outwardly apart from said peripheral edge, (ii) a plate (32) permanently attached to said side walls adjacent said upper edges, said plate having an upper surface (36) and a centerline (Y) generally parallel to said upper surface and said direction of travel, a first plane passing through said centerline and generally perpendicular to said upper surface (36), and (iii) a tooth (30) permanently attached to said plate (32) and extending outwardly from said upper edges and away from said boom and having a body including a pair of spaced apart side surfaces (51,52), a base (43,45), and a distal tip (46) spaced away from said plate, said side surfaces bracketing and spaced apart from a second plane which generally bisects said body, said tooth being attached to said plate in a position in which said base and second plane are at a first angle (B) with respect to said centerline, said angle (B) being defined by an arc lying in said upper surface of said plate and extending from said centerline to said base, and said second plane is canted away from said first plane at a second angle (A) such that said distal tip is a greater distance from said first plane than said base of said tooth; and, (d) a motor mounted on said frame to drive said chain.

4. The apparatus of claim 3, wherein said tooth is panel-shaped and said upper surface is flat.

5. The apparatus of claim 3, wherein said first angle is in the range of 15 degrees to 45 degrees and said second angle is in the range of five degrees to 40 degrees.

6. Apparatus for forming a trench, said apparatus including (a) a frame including a plurality of ground engaging wheels;

(b) a boom attached to and having a distal end extending outwardly from said frame, said distal end having a peripheral edge;

(c) a chain extending around said peripheral edge of said boom, said chain including a plurality of connector links and roller links, each connector link pivotally attached to and interconnecting a pair of said roller links, at least one of said connector links including (i) a pair of spaced apart opposed side walls each having an upper edge spaced outwardly apart from said peripheral edge, (ii) a plate (32) permanently attached to said side walls adjacent said upper edges, and (iii) a tooth (30) permanently attached to said plate and extending outwardly from said upper edges and away from said boom, said tooth including a cutting edge (35) which is rearwardly canted away from an axis (X) perpendicular to said plate (32) through an angle (D) in a direction opposite that of the general direction of travel of said chain; and, (d) a motor mounted on said frame to drive said chain.

7. The apparatus of claim 6 wherein said angle (D) is in the range of five to eight degrees.

8. The apparatus of claim 7 wherein said tooth includes a panel-shaped body having spaced apart sides (51, 52).

* * * * *